US005405684A

United States Patent [19]

Cockfield et al.

[11] Patent Number: 5,405,684

[45] Date of Patent: Apr. 11, 1995

[54] MOIRE FABRIC

[75] Inventors: Joe B. Cockfield, Belton; Sabrina B. Fadial, Spartanburg; Francis W. Marco, Pauline, all of S.C.

[73] Assignee: Milliken Research Corporation, Spartanburg, S.C.

[21] Appl. No.: 228,986

[22] Filed: Apr. 18, 1994

Related U.S. Application Data

[62] Division of Ser. No. 6,455, Jan. 21, 1993, Pat. No. 5,337,460.

[51] Int. Cl.[6] ..... D03D 3/00

[52] U.S. Cl. ..... 428/229; 26/69 R; 428/225; 428/257; 428/258; 428/253

[58] Field of Search ..... 26/69 R; 28/167; 428/225, 229, 257, 258, 253

[56] References Cited

U.S. PATENT DOCUMENTS

| | | | |
|---|---|---|---|
| 2,083,248 | 6/1937 | Teres | 26/69 |
| 2,448,145 | 8/1948 | Holterhoff | 26/69 |
| 2,513,646 | 7/1950 | Holterhoff | 26/69 |
| 2,598,795 | 6/1952 | Holterhoff | 26/69 |
| 2,926,414 | 3/1960 | Weiss et al. | 26/69 |
| 3,256,581 | 6/1968 | Thal et al. | 26/2 |
| 3,571,871 | 3/1971 | Caroselli et al. | 28/74 |
| 4,995,151 | 2/1991 | Siegel et al. | 26/69 |
| 5,080,952 | 1/1992 | Willbanks | 428/91 |
| 5,217,796 | 6/1993 | Kasai et al. | 428/229 |

FOREIGN PATENT DOCUMENTS

| | | | |
|---|---|---|---|
| 0177277 | 9/1985 | European Pat. Off. | 23/23 |
| 58-23963 | 7/1981 | Japan | 23/4 |
| 2-191764 | 8/1989 | Japan . | |

*Primary Examiner*—James J. Bell

*Attorney, Agent, or Firm*—Kevin M. Kercher; Terry T. Moyer

[57] ABSTRACT

An apparatus and method for creation of moiré fabric. This can be achieved by placing a first piece of fabric against a support member and directing ant least one stream of fluid at the surface of said first piece of fabric to provide lateral yarn displacement. Then delivering said stream at a peak dynamic pressure in excess of about 300 p.s.i.g. and less than 4,000 p.s.i.g. and selectively interrupting and re-establishing contact between said stream and said surface in accordance with pattern information in order to pattern said first piece of fabric. This is followed by combining said patterned first piece of fabric with an unpatterned second piece of fabric in overlapping relationship and applying pressure by means of calender rolls having smooth surfaces to said combination of said first piece of patterned fabric and said second piece of unpatterned fabric.

7 Claims, 9 Drawing Sheets

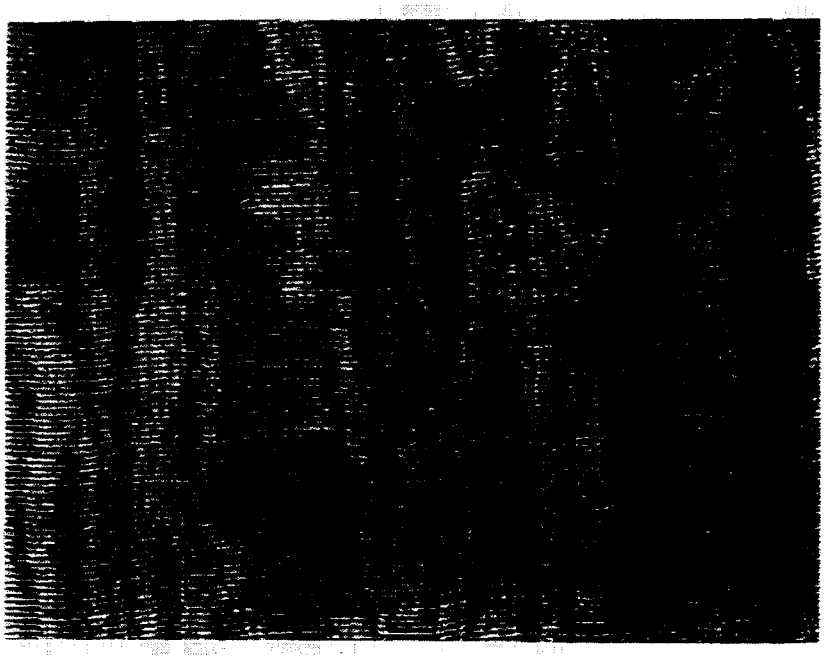
FIG. –15–
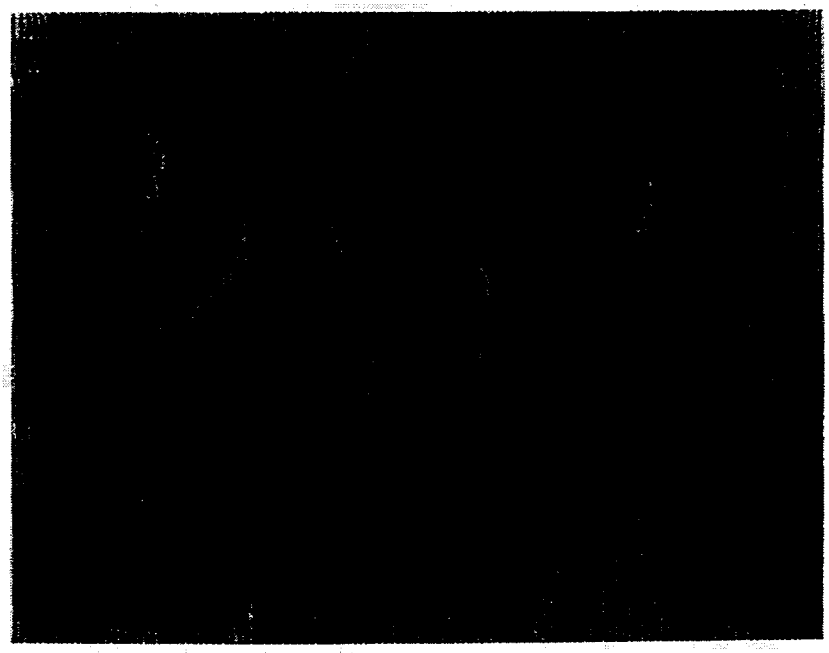
FIG. –16–

MOIRE FABRIC

This is a division of application Ser. No. 08/006,455, filed on Jan. 21, 1993 now U.S. Pat. No. 5,337,460, of Joe Barry Cockfield, Sabrina B. Fadial and Francis William Marco for METHOD AND APPARATUS TO CREATE AN IMPROVED MOIRÉ FABRIC.

BACKGROUND OF THE INVENTION

This invention relates to a method and apparatus for creation of moiré fabric. Traditional moiré fabrics are defined as a wavy or watered effect on textile fabric, especially a corded fabric of silk, rayon, or one of the manufactured fibers. An excellent example of a corded fabric would be a faille. Failles are generally defined as having fine, bright, continuous filament warps and coarse spun filling and a plain weave. This creates a noticeable ribbed effect in the filling direction. Other fabrics can be utilized with typically lesser results, however, a visible ribbed effect should be present in the fabric's filling.

Moiré fabric falls into one of two categories. The first is an uncontrolled moiré when the filling ribs of one layer of fabric is intentionally skewed with respect to the second layer of fabric prior to applying pressure to both layers of fabric. This will result in a significant increase in the number of filling ribs that cross with the associated increase in vertical moiré lines. This is very undesirable since the appearance of the moiré fabric will never be consistent and will vary from batch to batch.

Traditionally, controlled moiré fabric is formed by selectively distorting or skewing small portions of the filling ribs so that the filling ribs only cross in selective areas. The most common method is the Francais bar method in which ribbed woven fabric is dragged over a stationary bar which has a series of knobs which are spaced at desired intervals. This is done at very high tension. The knobs distort the filling into a bow wherever they touch the fabric. When two pieces of this fabric are subjected to pressure, a traditional controlled moiré will result that is typically found in upholstery, drapery, apparel, and other end uses. Problems with this type of moiré patterning include the fact that the pattern is repeatedly fixed and dragging under high tension can damage and/or destroy the fabric.

Another traditional method utilized in creating controlled moiré fabric is the "scratch" method. This is accomplished by means of a resilient roll having the desired designs embossed thereon. These designs may include flowers, geometrics, and so forth. While the fabric is in contact with this embossed roll, it is "scratched" with a series of steel blades which distort the filling yarns of the fabric according to the pattern embossed on the roll. Upon applying pressure to two pieces of this treated fabric, a moiré pattern is produced. Once again, there is the problem of the destruction or damage to yarns by the steel blades and a fixedly repeatable pattern. This "scratch" method produces very poor results with a large quantity of broken filaments. The blades actually only contact the warp yarns thus producing a large amount of broken filaments with only minimal movement of the filling yarn. It is the movement of the filling yarn that is the desired result. Furthermore, by examination of faille fabric, the filling is virtually covered by warp yarns and thus it is very difficult to move the filling by mechanical means. Also, this "scratch" method creates fuzz on the surface of the fabric that results in less shine and poor moiré patterns.

Yet another traditional method of producing a controlled moiré is by that found in U.S. Pat. No. 2,448,145, which discloses the selective application of water to fabric with a noticeable ribbed effect in the filling direction. The fabric is then placed under high tension and then dried. This will distort the filling yarns in the wet areas differently than the filling yarns in the dry areas. Again, upon applying pressure to two pieces of this treated fabric, a moiré pattern is produced. A severe problem with this technology is that it would be very difficult to selectively wet yarns while leaving adjacent yarns dry for a very precise pattern. Furthermore, stretching under high tension can severely weaken or even destroy filling yarns. Furthermore, this method is deficient in that it only works on fibers that absorb large amounts of water such as cotton, silk and so forth. Each pattern requires a specific patterning roll or screen which only changes the pick count slightly in the areas treated with water. While this may produce some beating when the fabrics are sandwiched and calendered it does not produce true moiré because the filling is not distorted with bow or skew.

The present invention solves these problems in a manner not disclosed in the known prior art.

SUMMARY OF THE INVENTION

An apparatus and method for creation of moiré fabric. This can be achieved by placing a first piece of fabric against a support member and directing at least one stream of fluid at the surface of said first piece of fabric to provide lateral yarn displacement. Then delivering said stream at a peak dynamic pressure in excess of about 300 p.s.i.g. and less than 4,000 p.s.i.g. and selectively interrupting and re-establishing contact between said stream and said surface in accordance with pattern information in order to pattern said first piece of fabric. This is followed by combining said patterned first piece of fabric with an unpatterned second piece of fabric in overlapping relationship and applying pressure by means of calender rolls having smooth surfaces to said combination of said first piece of patterned fabric and said second piece of unpatterned fabric.

It has been found that by using high pressure liquid jets having a moment of force in the plane of the fabric that there will be movement of the filling yarns in the fabric. This movement of the filling yarn is produced without damage to the warp yarns.

It is an unexpected advantage of this invention that surface fuzz on the fabric is forced to the back of the fabric. When high pressure liquid is applied to the fabric and subsequently the fabric is sandwiched and calendered, then beautiful moiré patterns are produced. The absence of fuzz in the patterned areas produces especially bright and clear moiré patterns.

Yet another advantage of this invention is to have moiré patterns of any length or, in other words, patterns that do not necessarily repeat.

Still another advantage of this invention is the means of patterning is relatively nondestructive and places a minimum of tension on the fabric.

Another advantage of this invention is extremely precise since it can selectively move individual yarns.

A further advantage of this invention is that patterning can be extremely complex with the only limits being those of the human imagination.

Another advantage of this invention is that patterning can be altered while the machine is processing and downloaded in real time with the only limits being those of the complexity of the available computer system utilized in the storage and retrieval of moiré patterns.

These and other advantages will be in part apparent and in part pointed out below.

BRIEF DESCRIPTION OF THE DRAWINGS

The above as well as other objects of the invention will become more apparent from the following detailed description of the preferred embodiments of the invention when taken together with the accompanying drawings, in which:

FIG. 15 is a photomicrograph (1.1×) of the face of the fabric of Example 2 after the step of selectively patterning the fabric by means of high pressure streams of liquid and the step of calendering under one ton of pressure per linear inch with a second layer of unpatterned untreated fabric;

FIG. 16 is a photomicrograph (1.1×) of the face of the fabric of Example 3 after the step of selectively patterning the fabric by means of high pressure streams of liquid.

DETAILED DESCRIPTION OF THE PREFERRED EMBODIMENT

Figure 1:
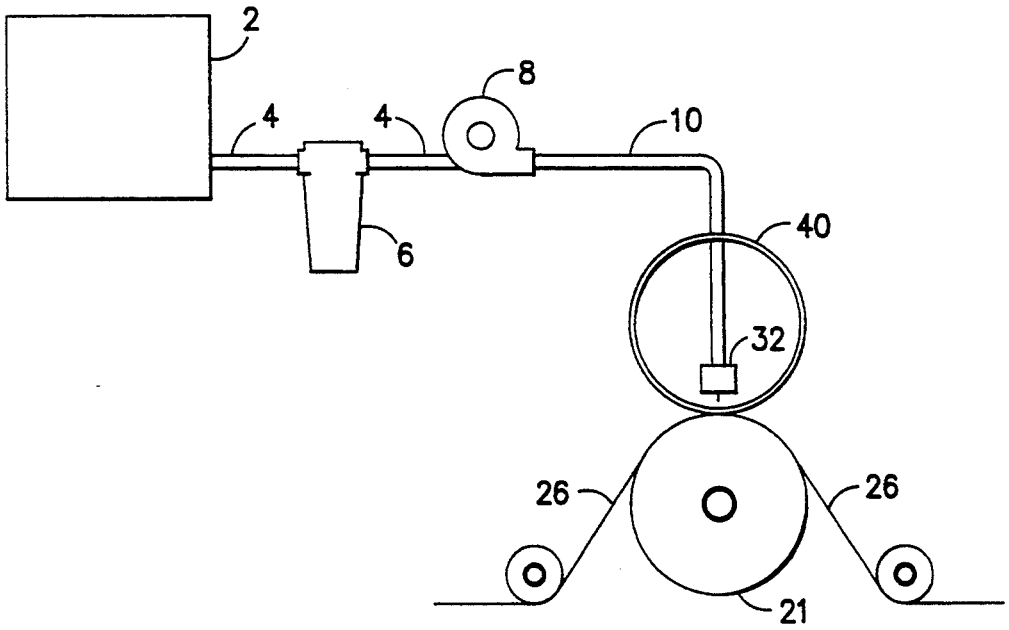
FIG. 1 is a schematicized side view of an apparatus for generating selectively patterned fabric wherein an array of liquid jets is placed inside a stencil in the form of a cylinder, which in turn is brought into close proximity to the fabric surface.
Figure 2:
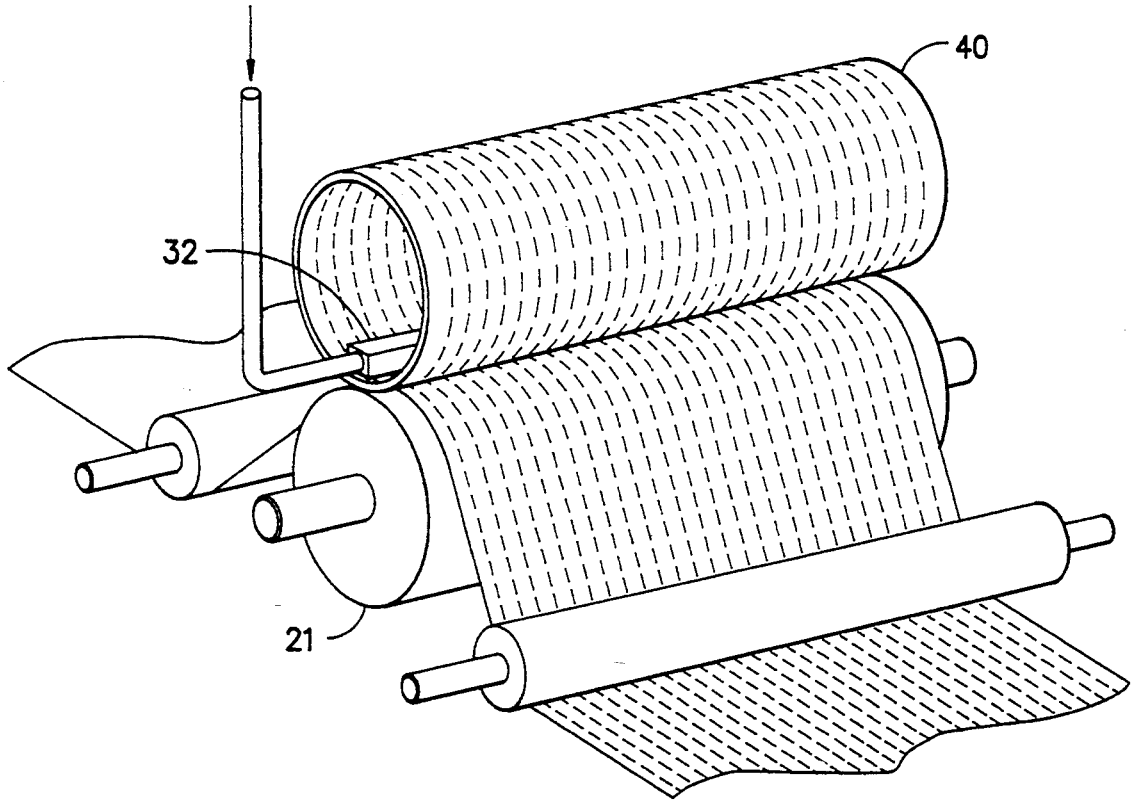
FIG. 2 is a diagrammatic perspective view of the apparatus of FIG. 1.

Referring now to the accompanying drawings, and initially to FIG. 1, which shows a schematicized side view of an apparatus for generating selectively pattern ribbed fabric wherein an array of liquid jets is placed inside a stencil in the form of a cylinder, which in turn is brought into close proximity to the fabric surface. The stencil is configured to allow the fabric to be patterned to be in the form of a moving web. FIGS. 1 and 2 show a configuration whereby a cylindrical stencil 40 is arranged to accommodate a multiple jet array orifice assembly such as shown at 32 within the stencil 40. In this configuration, orifice assembly 32 preferably comprises an array of jets which extends across the entire width of stencil 40, which in turn extends across the entire width of fabric web 26. Orifice assembly 32 is preferably located in close proximity to the inside surface of cylindrical stencil 40; the outer surface of stencil 40 is preferably located in close proximity to, and perhaps in direct contact with, the surface of fabric web 26. Means, not shown, are provided to achieve smooth rotation of stencil 40 in synchronism with the movement of fabric web 26. This may be achieved, for example, by an appropriate gear train operating on a ring gear which is associated with one or both ends of cylindrical stencil 40.

It is also contemplated that a single or multiple jet array may be used which is made to traverse within cylindrical stencil 40 so that the entire width of fabric web 26 may be treated. Use of such traversing jet or jet array would preferably require incremental movement of fabric web 26, as discussed above.

Where an array of high velocity jets may be individually controlled in response to pattern information, the apparatus shown in FIGS. 3 through 9, may be employed.

Figure 3:
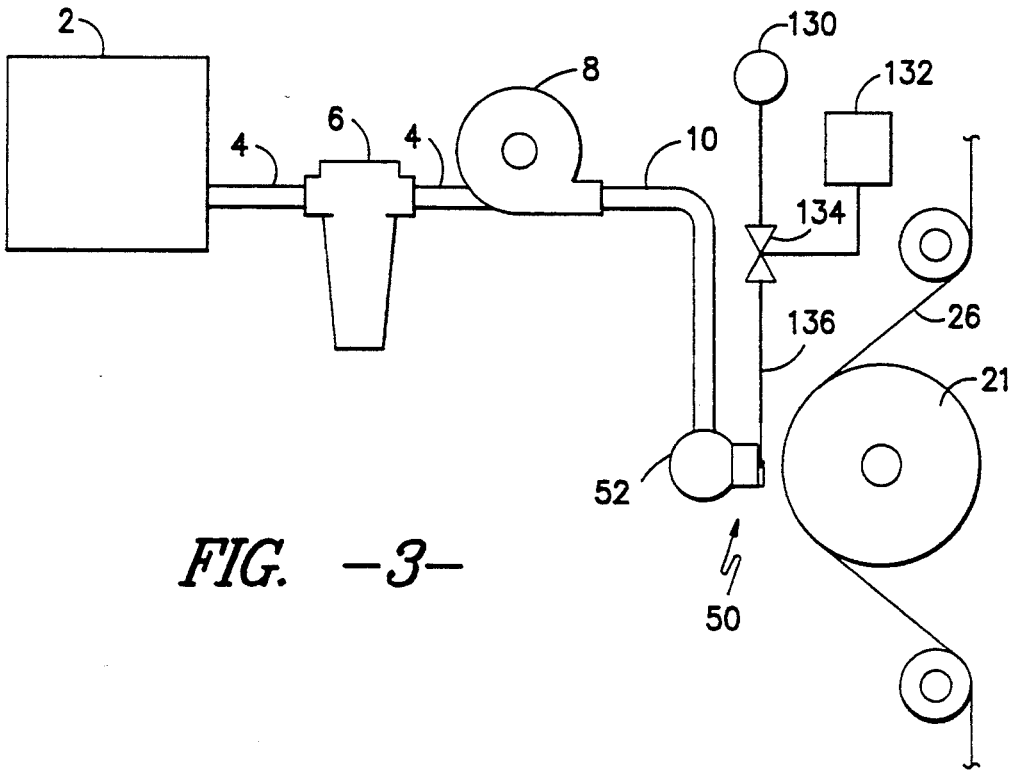
FIG. 3 is an overview of yet another apparatus which may be used to generate selectively patterned ribbed fabric disclosed herein.

FIG. 3 depicts an overall view of an apparatus designed to use a combination manifold/stream forming/-stream interrupting apparatus 50, which is depicted in more detail in FIGS. 4 through 9. Pump 8 is used to pump, via suitable conduits 4, 10, a working fluid such as water from a suitable source of supply 2 through an appropriate filter 6 to a high pressure supply duct 52, which in turn supplies water at suitable dynamic pressure (e.g., between 100 p.s.i.g. and 4,000 p.s.i.g.) to the manifold apparatus 50. Also, depicted in FIG. 3 are the conduits 136 for directing the control fluid, for example, slightly pressurized air as supplied from source 130, and valves 134 by which the flow of control fluid may be selectively established or interrupted in response to pattern information supplied by pattern data source 132. As will be explained in greater detail hereinbelow, establishing the flow of control fluid to manifold apparatus 50 via conduits 136, pressurized no higher than approximately one-twentieth of the pressure of the high velocity water, causes an interruption in the flow of high velocity water emanating from manifold apparatus 50. This will prevent the high velocity water from striking the substrate placed against backing member 21. Conversely, interrupting such control fluid flow causes the flow of high velocity water to impact the substrate 26 placed against backing member 21.

Figure 4:
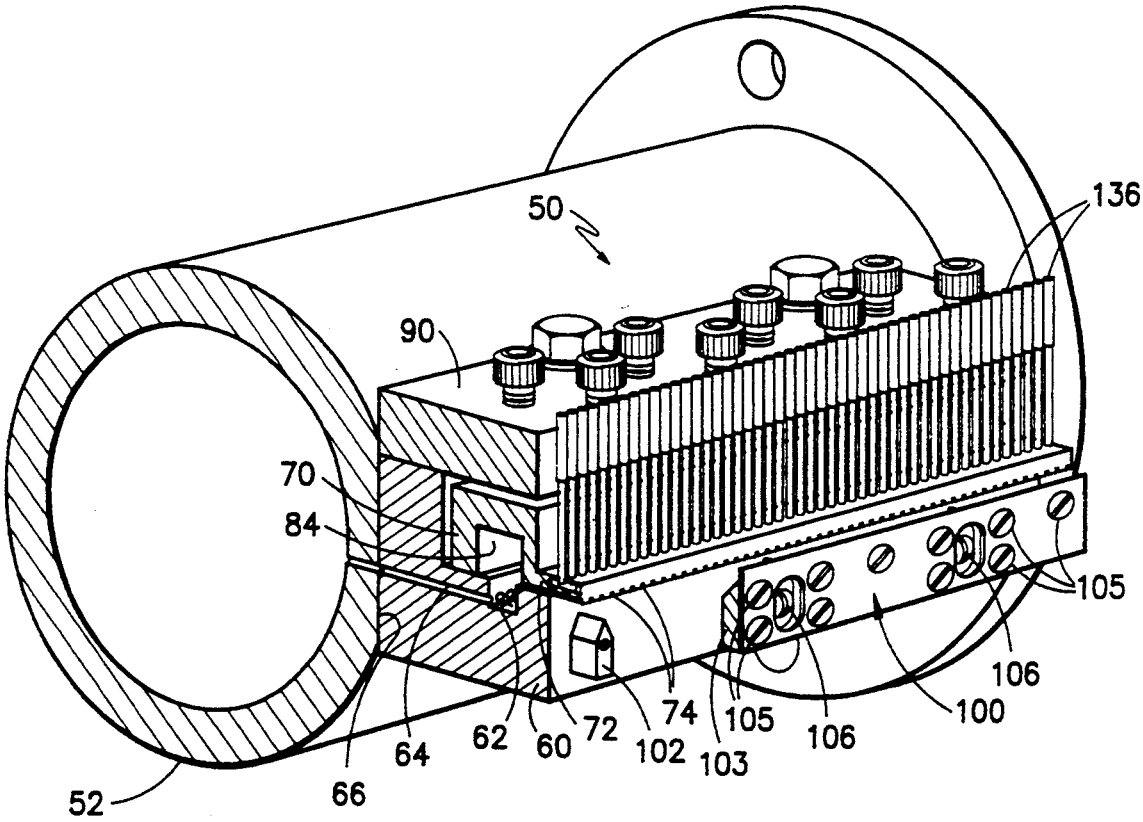
FIG. 4 is a perspective view of the high pressure manifold assembly depicted in FIG. 3.
Figure 5:
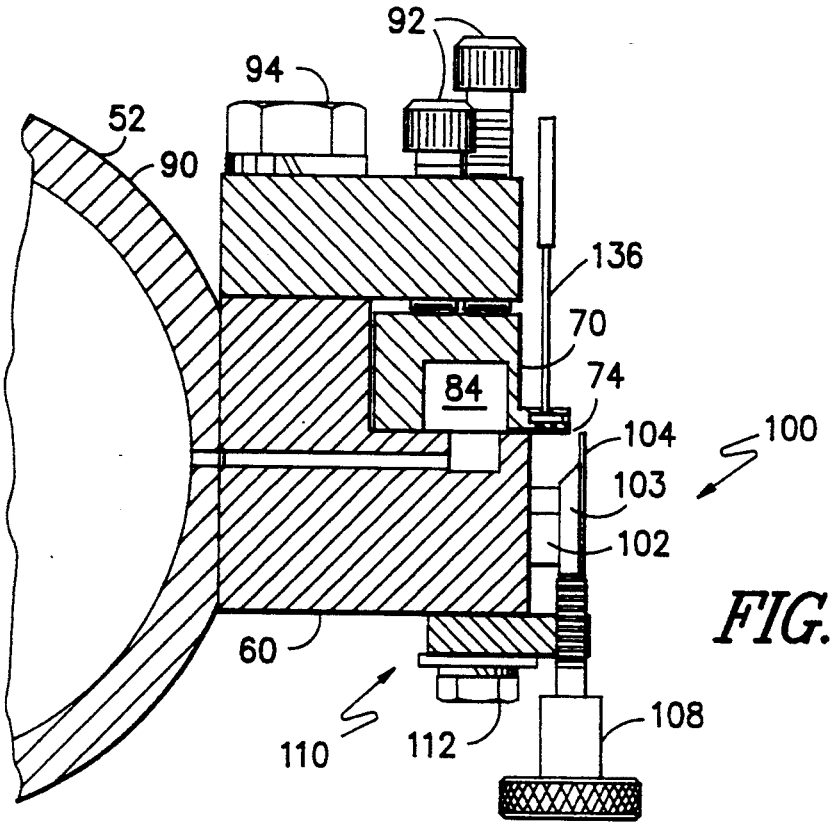
FIG. 5 is a side view of the assembly of FIG. 4, showing the alignment means used to align the containment plate depicted in FIG. 4.

Looking to FIG. 4, it may be seen that manifold assembly 50 is comprised of five basic structures: high pressure supply gallery assembly 60 (which is mounted in operable association with high pressure supply duct 52), grooved chamber assembly 70, clamping assembly 90, control fluid conduits 136, and spaced barrier plate assembly 100.

Supply gallery assembly 60 is comprised of an "L"-shaped member, into one leg of which is machined a uniform notch 62 which extends, uninterrupted, along the entire length of the assembly 50. A series of uniformly spaced supply passages 64 are drilled through the side wall 66 of assembly 60 to the corresponding side wall of notch 62, whereby notch 62 may be supplied with high pressure water from high pressure supply duct 52, the side of which may be appropriately milled, drilled, and connected to side wall 66 and the end of respective supply passages 64. Slotted chamber assembly 70 is comprised of an elongate member having an inverted hook-shaped cross-section, and having an extending leg 72 into which have been machined a series of closely spaced parallel slots or grooves 74 each having a width approximately equal to the width of the desired high velocity treatment stream, and, associated with each slot, a series of communicating control fluid passages, shown in greater detail in FIGS. 6 through 9. These control passages are connected to control fluid conduits 136, through which is supplied a flow of low pressure control fluid during those intervals in which the flow of high pressure fluid flowing through slots 74 is to be interrupted.

As shown in FIGS. 6 through 9, the control fluid passages are comprised of a pair of slot intercept passages 76 spaced along the base of each slot and connected to an individual elongate chamber 78 which is aligned with the axis of its respective slot 74. Each slot 74 has associated with it a respective chamber 78, which in turn is connected, via respective individual control supply passages 80, to a respective control fluid conduit 136. In practice, chambers 78 may be made by drilling a passage of the desired length from the barrier plate (104) side of chamber assembly 70, then plugging the exit hole in a manner appropriate to contain the relatively low pressure control fluid.

Figure 8:
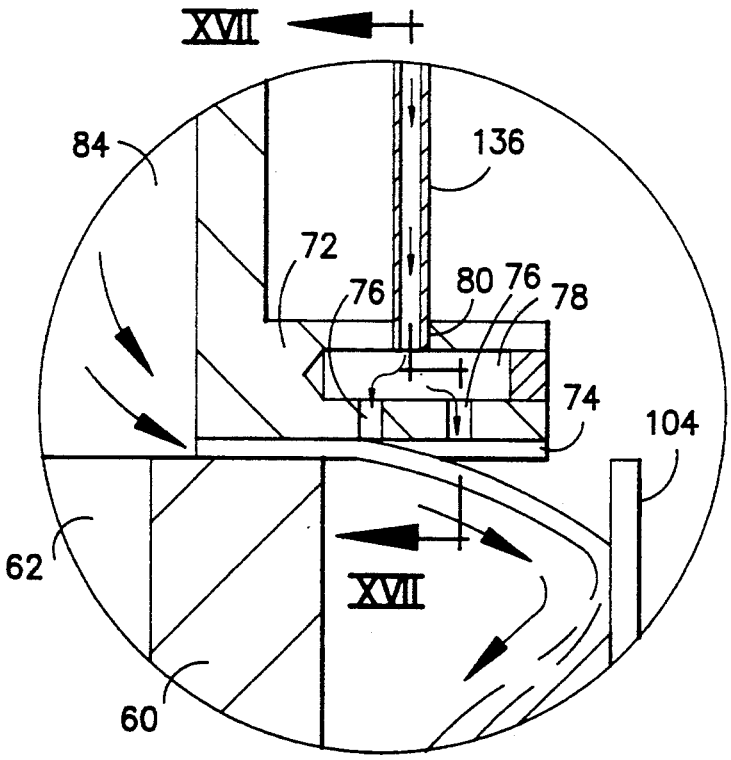
FIG. 8 is an enlarged, cross-section view of the encircled portion of FIG. 7.
Figure 9:
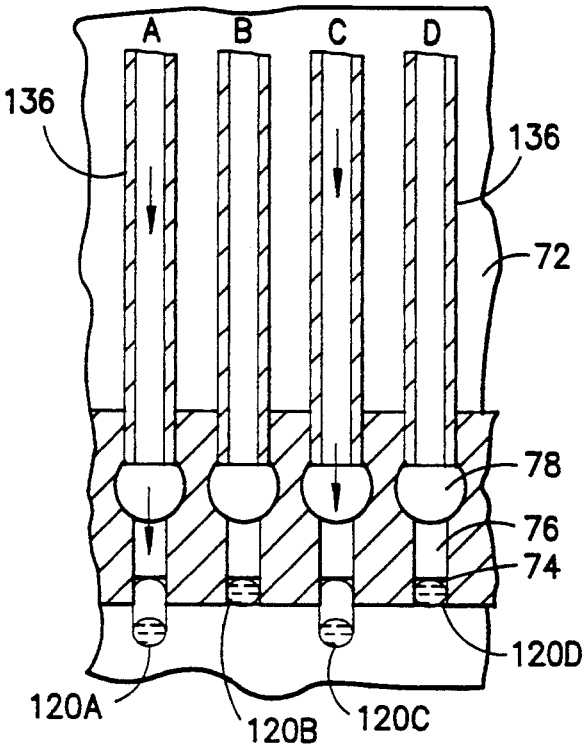
FIG. 9 is a cross-section view taken along lines XVII--XVII of FIG. 8, depicting the deflection of selected working fluid jets by the flow of control fluid.

Grooved chamber assembly 70 is positioned, via clamping assembly 90, within supply gallery assembly 60 so that its "C"-shaped chamber is facing notch 62, thereby forming a high pressure distribution reservoir chamber 84 in which, as depicted in FIGS. 8 and 9, high pressure water enters notch 62 via passages 64, enters reservoir chamber 84, and flows through slots 74 towards the substrate 26. Clamping assembly 90 is provided along its length with jacking screws 92 as well as bolts 94 which serve to securely attach clamping assembly 90 to supply gallery assembly 60 along the side opposite barrier plate assembly 100. It is important to note that the configuration and placement of slotted chamber assembly 70 provides for slots 74 to be entirely covered over the portion of slots closest to reservoir chamber 84, but provides for slots 74 to be uncovered or open over the portion of slots nearest barrier plate assembly 100, and particularly over that portion of the slots 74 opposite and immediately downstream of slot intercept passages 76.

Associated with supply gallery assembly 60 and attached thereto via tapered spacing supports 102 is spaced barrier plate assembly 100, comprising a rigid plate 104 having an edge which is positioned to be just outside the path of the high velocity stream as the stream leaves the confines of slot 74 and exits from the end of chamber: assembly 70, and crosses the plane defined by plate 104. To ensure rigidity of plate 104, elongate backing plate 103 is securely attached to the inside surface of plate 104, via screws 105 positioned along the length of plate 104. Screws 106, which thread into threaded holes in spacing supports 102, are used to fix the position of plate 104 following alignment adjustment via threaded alignment bolts 108. Bolts 108 are associated with alignment guide 110 which is, at the time of machine set up, attached to the base of supply gallery assembly 60 via screws 112. By turning bolts 108, precise and reproducible changes in the relative elevation of plate 104, and thereby the clearance between the distal or upstanding edge of plate 104 and the path of the high velocity fluid jet(s), may be made. After the plate 104 is brought into satisfactory alignment relative to slots 74, screws 106 may be tightened and alignment guide 110, with bolts 108, may be removed, thereby fixing the edge of plate 104 in proper relation to the base of slots 74.

Figure 6:
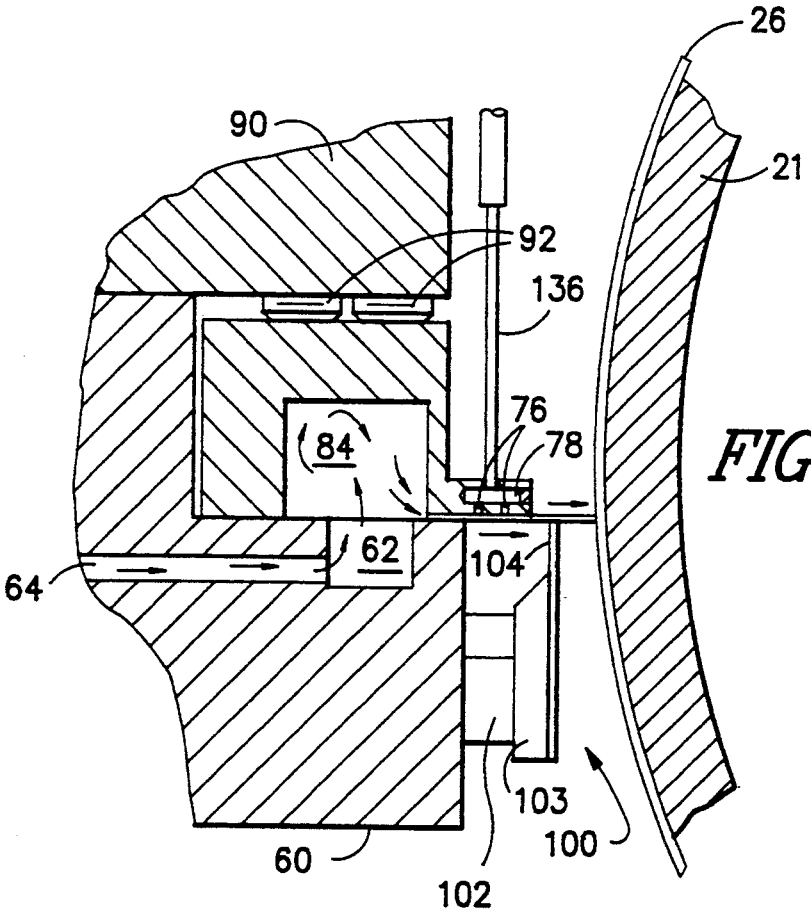
FIG. 6 is a cross-section view of the assembly of FIG. 4, without the alignment means, showing the path of the high velocity fluid through the manifold, and the path of the resulting fluid stream as it strikes a substrate placed against the support roll.
Figure 7:
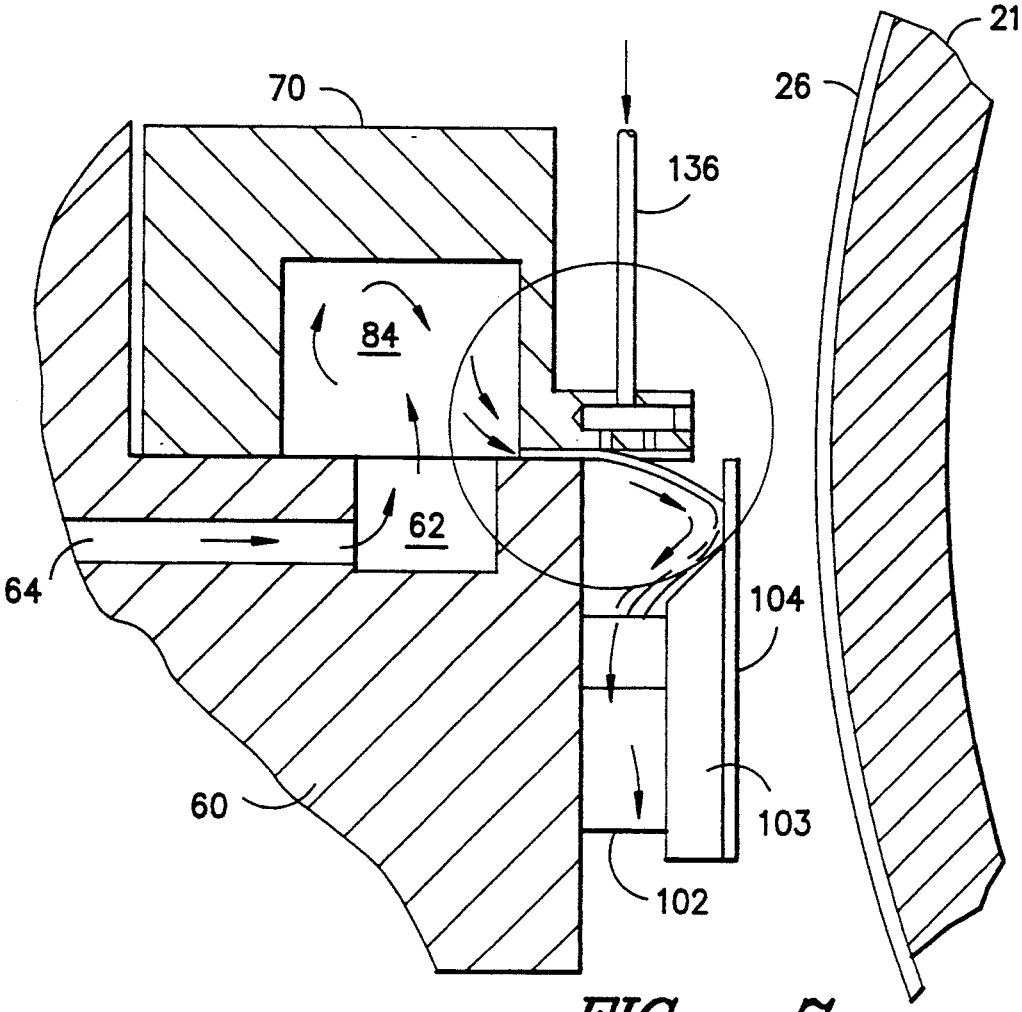
FIG. 7 depicts a portion of the view of FIG. 6, but wherein the fluid stream is prevented from striking the target substrate by the deflecting action of a stream of control fluid.

FIGS. 6 and 7 depict a fluid jet(s) impacting the substrate 26 perpendicular to the plane of tangency to the surface of support roll 21 at the point of impact; in some cases, however, it may be advantageous to direct the fluid jet(s) at a small angle relative to such plane, in either direction (i.e., either into or along the direction of rotation of roll 21). Generally, such angles (hereinafter referred to as "inclination angles") are about twenty degrees or less, but may be more for some applications.

As depicted in FIG. 7, when no control fluid is flowing through conduit 136 and slot intercept passages 76, highly pressurized water from passages 64 fills high pressure reservoir chamber 84 and is ejected towards substrate 26, via slots 74, in the form of a high velocity stream which passes in close proximity to the distal or upstanding edge of barrier plate 104. The high velocity streams are formed as the high pressure water is forced through the passages formed by covered portions of slots 74; the streams retain substantially the same cross section as they travel along the uncovered portion of slots 74 between supply gallery assembly 60 and barrier plate 104, diverging only slightly as they leave the confines of the slots 74, pass the upstanding portion of barrier plate 104, and strike the substrate 26.

As depicted in FIGS. 7 and 8, when a "no treatment" signal is sent to a valve controlling the flow of control fluid in a given conduit 136, a relatively low pressure control fluid, e.g., air, is made to flow from the selected conduit 136 into the associated slot intercept passages 76 of a given slot 74, and the high velocity stream traveling along that slot is subjected to a force directed to the open side of the slot 74. Absent a counteracting force, this relatively slight pressure introduced by the control fluid causes the selected high velocity stream to leave the confines of the slot 74 and strike the barrier plate rather than the substrate, where its energy is dissipated, leaving the substrate untouched by the energetic stream. In a preferred embodiment of the apparatus, a separate electrically actuated air valve such as the Tomita Tom-Boy JC-300, manufactured by Tomita Co., Ltd., No. 18-16 1 Chome, Ohmorinaka, Ohta-ku, Tokyo, Japan, is associated with each control stream conduit. A valve actuating signal may be generated by conventional computer means, i.e., via an EPROM or from magnetic media, and routed to the respective valves, whereby the high velocity treatment streams may be selectively and intermittently actuated in accordance with supplied pattern data.

FIG. 9 is a section view taken through lines XVII–XVII of FIG. 8, and diagrammatically indicates the effects of control fluid flow in conduits 136. As indicated, low pressure control fluid is flowing in control stream conduits 136 identified as "A" and "C", while no control fluid is flowing in conduits 136 identified as "B" and "D". In conduits "A" and "C", the high velocity jets 120A and 120C, respectively, have been dislodged from the lateral walls of slots 74 and are being deflected on a trajectory which will terminate on the inner surface of barrier plate 104. In contrast, no control fluid is flowing in conduits 136 identified as "B" and "D"; as a consequence, the high velocity jets 120B and 120D, laterally defined by the walls of slots 74, are on a trajectory which will avoid the upstanding edge of barrier plate 104 and terminate on the surface of roll 21, or substrate 26 supported thereby.

Additional information relating to the operation of such a spraying apparatus, including more detailed description of patterning and control functions, can be found in coassigned U.S. Pat. No. 5,080,952, that issued on Jan. 14, 1992, which is incorporated by reference as if fully set forth herein.

Water jet patterns may also be produced by having a raised or embossed support plate or roll that is positioned behind the fabric and treated by an array of water jets. Because of the different surfaces behind the fabric, the pattern will be implemented in the fabric as disclosed by U.S. Pat. No. 4,995,151, which issued on Feb. 26, 1992, which is incorporated by reference as if fully set forth herein.

All of the above methods must use a stream, jet or sheet of water that has some moment of force in the plane of the fabric which will produce the desired filling shift in the patterned area. The range of water pressure is between 100 to 4,000 p.s.i.g. The water pressure necessary to produce the desired filling yarn shift is determined by the moment of force in the plane of the fabric, size of the water jet, and the time the water jet is in contact with the filling yarn.

Figure 10:
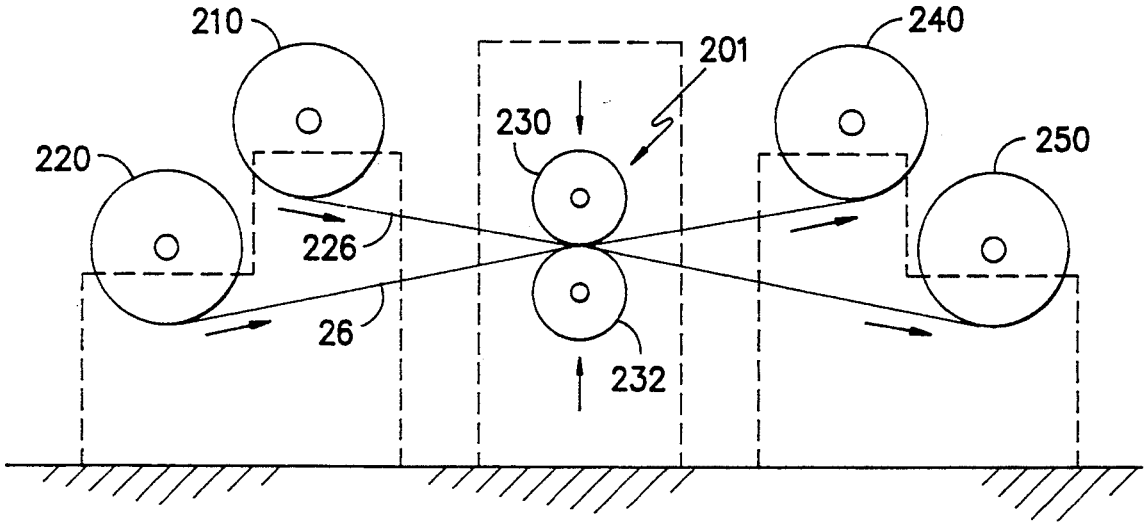
FIG. 10 is a diagrammatic side view of two supply rolls, two calendering rolls and two take-up rolls.

Referring now to FIG. 10, the next step in the process is to take the patterned fabric 26 and have this patterned fabric processed by a calender mechanism that is generally indicated by numeral 201. The patterned fabric 26 is placed on supply roll 220 and an unpatterned fabric 226 is placed on supply roll 210. Both the patterned fabric 26 and unpatterned fabric 226 are fed into an upper calendering roll 230 and lower calendering roll 232. For good patterning, both the patterned fabric 26 and unpatterned fabric 226 should be ribbed since the surface of the upper calendering roll 230 is smooth as well as the surface of lower calendering roll 232. The moiré pattern is made by placing these two layers of ribbed fabric 26 and 226 on top of each other so that the ribs of the upper unpatterned fabric 226 are slightly off-grain in relation to the lower patterned fabric 26. These true moiré patterns are produced when the upper unpatterned fabric 226 is sandwiched with the lower patterned fabric 26 and passed through the calender rolls 230 and 232 at high pressure so that wherever the filling yarns cross a moiré pattern is produced. The unpatterned fabric 226 may be the lower fabric with the patterned fabric 26 being the upper fabric with no consequential difference. A pressure of 300 to 10,000 pounds per linear inch of fabric between the upper calendering roll 230 and lower calendering roll 232 on the fabrics 26 and 226 causes the ribbed pattern of the patterned fabric 26 to be pressed into the unpatterned fabric 226 and visa-versa. Pressure requirements for producing moiré depend on the speed of traverse, temperature, moisture, and types of calender rolls utilized. A typical range for temperature would be between 100 and 450 degrees Fahrenheit. A typical range for moisture would be between 30 and 100 percent relative humidity for natural fibers. Manmade fibers are typically unaffected by relative humidity. The speed of traverse is typically between 10 and 100 feet per minute.

Flattened areas in the ribs reflect more light and create a contrast to unflattened areas. The patterned fabric 26 and unpatterned fabric 226 are then received by take-up rolls 250 and 240, respectively. The crushed and uncrushed portions of either fabric 26 or fabric 226 causes a difference in light reflectance. This creates a wavy or watery effect in both fabrics 26 and 226, respectively. In this case, both fabrics 26 and 226 will have the same moiré pattern but they will be mirror images. This technique is especially useful when geometric or floral patterns are used. If both fabrics 26, 226 are patterned, they would be very difficult to keep in register.

Beat repeat patterns may be introduced by having the pick count different in the two layers of fabric 26 and 226 sandwiched together. This may be accomplished by weaving two different pick counts. Another way to accomplish this is to place tension on one of the layers which will reduce the pick count slightly to produce a beating. "Beating" is defined as the pattern developed due to superimposed waves of different frequencies.

Some very beautiful fabrics are produced by creating the moiré fabric and then printing the fabric with a colorant such as a dye or pigment. The fabric may, also, be printed first and then water jet patterned and then calendered under pressure to produce a different effect. It may also be water jet patterned, printed and then calendered to produce a novel fabric. Any type of fabric printing may be used including but not limited to rotary screen, flat bed, air brush or engraved roll.

Most fiber types will work with this invention including, but not limited to, polyester, polyamide, acetate, rayon, cotton, and so forth. This invention is not restricted to plain weaves but most woven fabrics will work including, but not limited to, dobby and jacquard woven fabrics. Woven fabrics have warp yarns extending in the warp direction and fill yarns extending in the fill direction. For best results it is the fill yarns that have a ribbed effect. Furthermore, this invention is not restricted to woven fabrics since a moiré pattern can be applied to warp knit fabrics. Warp knit fabrics have wales which are a column of loops lying lengthwise in the fabric and correspond to the warp in woven fabrics. Also, warp knit fabrics have courses which are a row of loops or stitches running across a knit fabric corresponding to filing in woven fabrics.

Fabric 226 does not have to be unpatterned and may also be patterned with a different pattern than patterned fabric 26. Also, either fabric 26 or 226 may have a different pick count to produce a beating pattern.

Other methods of applying pressure include high pressure rotary presses and platen presses.

The following examples demonstrate, without intending to be limiting in any way, the method by which fabrics of the present invention have been generated.

EXAMPLE 1

An apparatus similar to that schematically depicted in FIG. 3 was used, in accordance with the following specifications.

Figure 11:
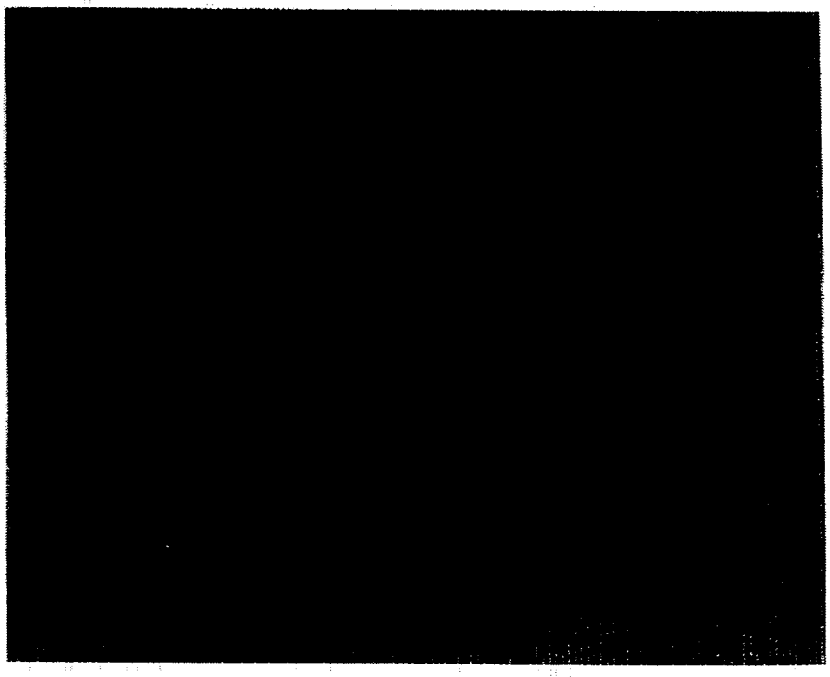
FIG. 11 is a photomicrograph (1.1×) of the face of the untreated faille fabric of Example 1.

Fabric: a faille fabric having a warp comprised of 130 ends/inch of 70 denier bright polyester continuous filament and a fill comprised of 8/1 spun polyester and a pick count of 35. The faille fabric has been woven, prepared, dyed and heatset and has a weight of 5.6 ounces per square yard. A photomicrograph of this fabric is shown by FIG. 11 at 1.1 magnification. This fabric was then patterned with diagonal lines Nozzle diameter: 0.017 inches.

Fluid: water, at a pressure of 1,000 p.s.i.g.

Pattern gauge: 20 lines per inch.

Source of pattern data: EPROM, with appropriate associated electronics of conventional design.

Figure 12:
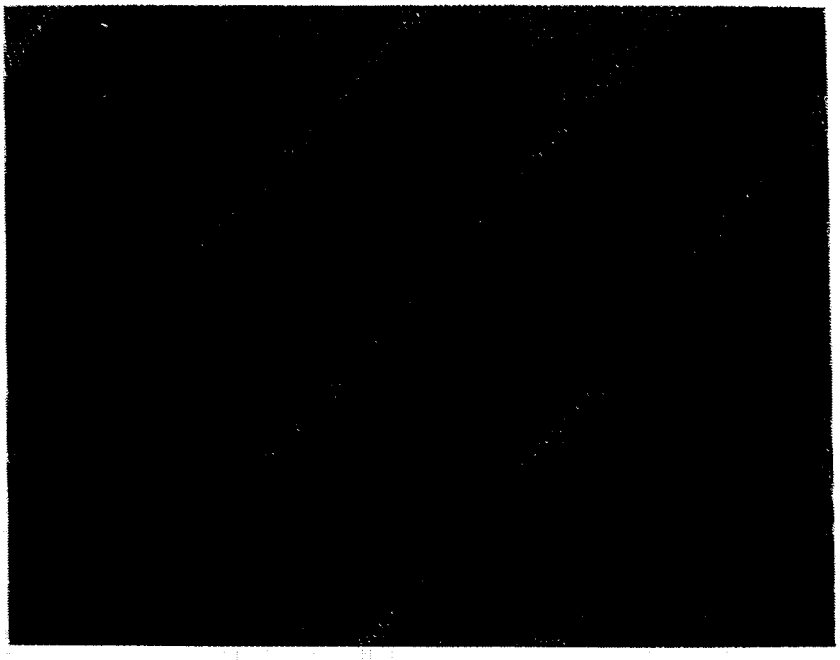
FIG. 12 is a photomicrograph (1.1×) of the face of the fabric of Example 1 after the step of selectively patterning the fabric by means of high pressure streams of liquid.

Roll: solid, smooth aluminum, rotating at a circumference speed of 10 yards per minute in the same direction as warp yarns in fabric. In this Example, the entire fabric surface was treated in a series of diagonal spaced lines. The yarns have been laterally displaced where the stream impacted the fabric. A photomicrograph of this treated fabric is shown by FIG. 12 at 1.1 magnification.

Figure 13:
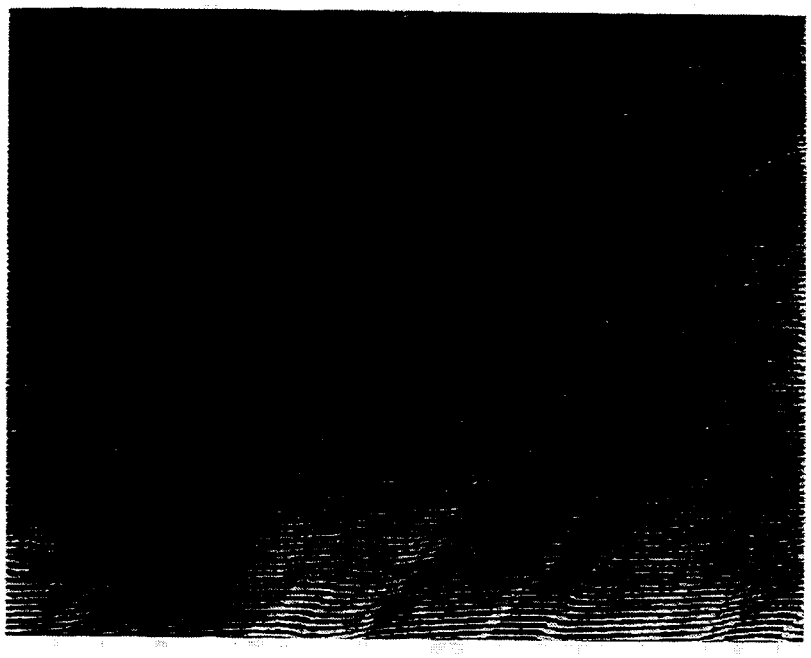
FIG. 13 is a photomicrograph (1.1×) of the face of the fabric of Example 1 after the step of selectively patterning the fabric by means of high pressure streams of liquid and the step of calendering under one ton of pressure per linear inch with a second layer of the untreated fabric of FIG. 11.

This patterned fabric was then sandwiched with an unpatterned piece of the same fabric and run through a BRIEM® calender at eight yards a minute with a temperature of three-hundred and eighty degrees Fahrenheit on the steel roll with a pressure of one ton per linear inch. BRIEM® calenders were formally manufactured by Ernest L. Frank Associates, Inc., 515 Madison Avenue, New York, N.Y. 10022, who is no longer in existence. Both pieces of fabric display the moiré pattern shown by the photomicrograph of FIG. 13 at 1.1 magnification.

EXAMPLE 2

An apparatus similar to that schematically depicted in FIG. 3 was used, in accordance with the following specifications.

Fabric: a faille fabric, as described in Example 1, having a warp comprised of 130 ends/inch of 70 denier bright polyester continuous filament and a fill comprised of 8/1 spun polyester and a pick count of 35. The faille fabric has been woven, prepared, dyed and heatset and has a weight of 5.6 ounces per square yard. This fabric was then patterned with linear wavy lines.

Nozzle diameter: 0.017 inches.

Fluid: water, at a pressure of 1,000 p.s.i.g.

Pattern gauge: 20 lines per inch.

Source of pattern data: EPROM, with appropriate associated electronics of conventional design.

Roll: solid, smooth aluminum, rotating at a circumference speed of 10 yards pert minute in the same direction as warp yarns in fabric.

Figure 14:
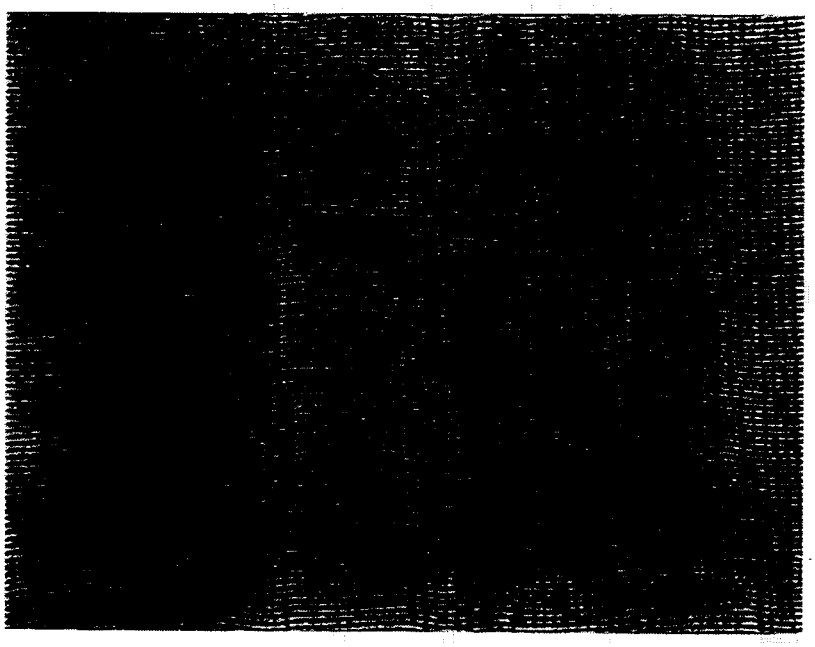
FIG. 14 is a photomicrograph (1.1×) of the face of the fabric of Example 2 after the step of selectively patterning the fabric by means of high pressure streams of liquid.

In this Example, the entire fabric surface was treated in a series of linear wavy lines. The yarns have been laterally displaced where the stream impacted the fabric. A photomicrograph of this treated fabric is shown by FIG. 14 at 1.1 magnification.

This patterned fabric was then sandwiched with an unpatterned piece of the same fabric and run through a BRIEM® calender at eight yards a minute with a temperature of three-hundred and eighty degrees Fahrenheit on the steel roll with a pressure of one ton per linear inch. Both pieces of fabric display the moiré pattern shown by the photomicrograph of FIG. 15 at 1.1 magnification.

EXAMPLE 3

An apparatus similar to that schematically depicted in FIG. 3 was used, in accordance with the following specifications.

Fabric: a faille fabric, as described in Example 1, having a warp comprised of 130 ends/inch of 70 denier bright polyester continuous filament and a fill comprised of 8/1 spun polyester and a pick count of 35. The faille fabric has been woven, prepared, dyed and heatset and has a weight of 5.6 ounces per square yard. This fabric was then patterned with a floral pattern.

Nozzle diameter: 0.017 inches.

Fluid: water, at a pressure of 1000 p.s.i.g.

Pattern gauge: 20 lines per inch.

Source of pattern data: EPROM, with appropriate associated electronics of conventional design.

Roll: solid, smooth aluminum, rotating at a circumference speed of 10 yards per minute in the same direction as warp yarns in fabric.

Figure 17:
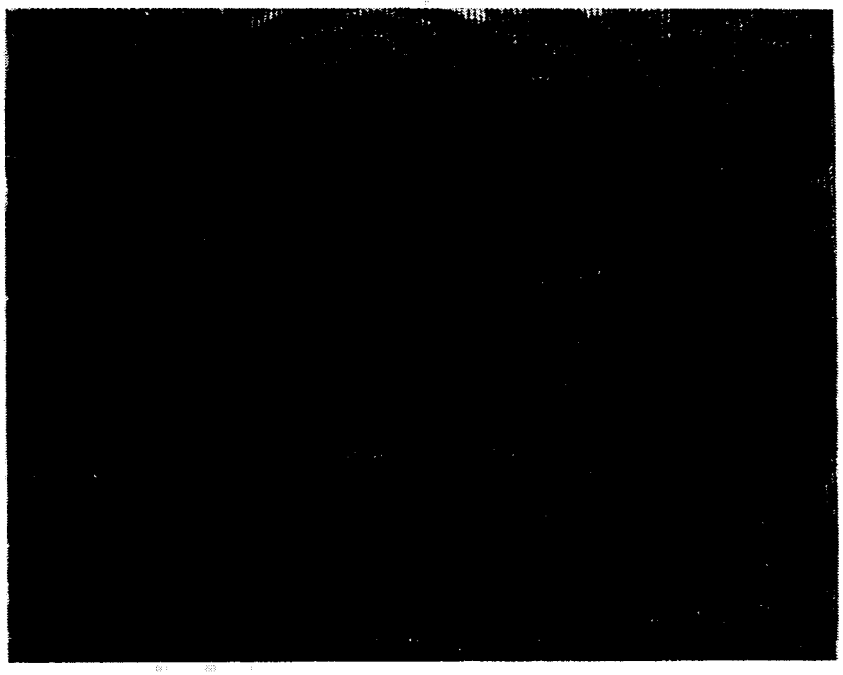
FIG. 17 is a photomicrograph (1.1×) of the face of the fabric of Example 3 after the step of selectively patterning the fabric by means of high pressure streams of liquid and the step of calendering under one ton of pressure per linear inch with a second layer of patterned fabric.

In this Example, the entire fabric surface was treated in a floral pattern. The yarns have been laterally displaced where the stream impacted the fabric. A photomicrograph of this treated fabric is shown by FIG. 16 at 1.1 magnification. This patterned fabric was then sandwiched with another patterned piece of the same fabric and run through a BRIEM® calender at eight yards a minute with a temperature of three-hundred and eighty degrees Fahrenheit on the steel roll with a pressure of one ton per linear inch. Both pieces of fabric display the moiré pattern shown by the photomicrograph of FIG. 17 at 1.1 magnification.

As this invention may be embodied in several forms without departing from the spirit or essential character thereof, the embodiments presented herein are intended to be illustrative and not descriptive. The scope of the invention is intended to be defined by the following appended claims, rather than any descriptive matter hereinabove, and all embodiments of the invention which fall within the meaning and range of equivalency of such claims are, therefore, intended to be embraced by such claims.

What is claimed is:

1. A woven fabric having warp yarns extending in the warp direction and fill yarns extending in the fill direction and said fill yarns having a ribbed effect and having a first side and a second side and a moiré pattern formed by shifted fill yarns in which substantially all surface fuzz on said shifted fill yarns is located on said second side of said woven fabric.

2. A woven fabric having warp yarns extending in the warp direction and fill yarns comprising of a plurality of fibers extending in the fill direction and said fill yarns having a ribbed effect and having a first side and a second side and a moiré pattern formed by shifted fill yarns in which substantially all surface fuzz on said shifted fill yarns is located on said second side of said woven fabric and substantially all of said warp yarns are non-broken.

3. A woven fabric as recited in claim 2, wherein said warp yarns include continuous fibers and said fill yarns include continuous fibers.

4. A woven fabric as recited in claim 2, wherein said warp yarns include staple fibers and said fill yarns include continuous fibers.

5. A woven fabric as recited in claim 2, wherein said warp yarns include continuous fibers and said fill yarns include staple fibers.

6. A woven fabric as recited in claim 2, wherein said warp yarns include staple fibers and said fill yarns include staple fibers.

7. A warp knit fabric having wale yarns extending in the wale direction and course yarns extending in the course direction and said wale yarns having a ribbed effect and having a first side and a second side and a moiré pattern formed by shifted wale yarns in which substantially all surface fuzz on said shifted wale yarns is located on said second side of said warp knit fabric and substantially all of said wale yarns are non-broken.

* * * * *